US006805509B2

(12) United States Patent
Ahn

(10) Patent No.: US 6,805,509 B2
(45) Date of Patent: Oct. 19, 2004

(54) PAPER SENSING APPARATUS OF IMAGE FORMING MACHINE

(75) Inventor: Byung-sun Ahn, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/393,247

(22) Filed: Mar. 21, 2003

(65) Prior Publication Data

US 2003/0215274 A1 Nov. 20, 2003

(30) Foreign Application Priority Data

May 14, 2002 (KR) ..... 2002-0026566

(51) Int. Cl.[7] ..... B41J 29/393

(52) U.S. Cl. ..... 400/709; 400/708; 400/707.1; 400/708.1; 400/596; 271/227; 271/229; 271/258.05

(58) Field of Search ..... 400/703, 707.1, 400/708, 708.1, 709, 711, 596; 271/227, 229, 258.05, 152

(56) References Cited

U.S. PATENT DOCUMENTS 4,557,589 A * 12/1985 Fukushi ..... 399/403
4,607,838 A * 8/1986 Matsuyama et al. ..... 271/293
5,042,790 A * 8/1991 Miller et al. ..... 271/110
5,074,545 A * 12/1991 Handa ..... 271/227
5,203,555 A * 4/1993 Cannaverde et al. ..... 271/263
5,539,510 A * 7/1996 Yamashiro et al. ..... 399/9
5,549,402 A * 8/1996 Yamaguchi ..... 400/708
5,718,527 A * 2/1998 Fujimoto et al. ..... 400/616.1
5,850,246 A * 12/1998 Maslanka et al. ..... 347/197
5,971,638 A * 10/1999 Sato et al. ..... 400/578
6,152,443 A * 11/2000 Claramunt et al. .... 271/258.05
6,292,636 B1 * 9/2001 Kwon ..... 399/16

* cited by examiner

*Primary Examiner*—Andrew H. Hirshfeld
*Assistant Examiner*—Dave A. Ghatt
(74) *Attorney, Agent, or Firm*—Staas & Halsey, LLP

(57) ABSTRACT

A paper sensing apparatus of an office machine has a sensor actuator disposed to pivot with respect to a pivot center of a conveying roller by a printing paper when the printing paper is conveyed, and a sensing unit generating a paper sensing signal in accordance with a rotation of the sensor actuator. Accordingly, the paper sensing apparatus is capable of accurately sensing a leading end of the printing paper, and thus a top margin of the printing paper can be effectively controlled as the paper sensing apparatus is installed to be operated with respect to a rotation center of the conveying roller so that an error generated during sensing a paper top position due to a lengthened distance between the conveying roller and a transferring roller can be reduced.

41 Claims, 6 Drawing Sheets

PAPER SENSING APPARATUS OF IMAGE FORMING MACHINE

CROSS-REFERENCE TO RELATED APPLICATIONS

This application claims the benefit of Korean Patent Application No. 2002-26566, filed May 14, 2002, in the Korean Intellectual Property Office, the disclosure of which is incorporated herein by reference.

BACKGROUND OF THE INVENTION

1. Field of the Invention

The present invention relates to an office machine, such as a laser printer and a copying machine, and more particularly, to a paper sensing apparatus of an office machine, which is capable of controlling a top margin of a printing paper effectively by exactly sensing a leading end of the printing paper picked up by a pickup roller and conveyed by conveying rollers.

2. Description of the Related Art

An input/output apparatus for performing printing on a medium of printing paper, for example, an office machine, such as an inkjet printer, a laser printer, or a facsimile, generally has a paper sensing apparatus for sensing a leading end of the printing paper to control a top margin of the printing paper.

For example, as shown in FIG. 1, a laser printer 10 includes a paper stacking unit 1 containing sheets of printing paper P therein, a paper conveying unit 2 conveying the printing paper P from the paper stacking unit 1, an image forming unit 6 forming a toner image on the printing paper P conveyed by the paper conveying unit 2, a paper sensing apparatus 30 disposed between the paper conveying unit 2 and the image forming unit 6 to sense a leading end of the printing paper P, a settling unit 7 settling the toner image formed on the printing paper P by applying certain heat and pressure to the toner image and the printing paper P, and a paper discharging unit 8 discharging the printing paper P having the settled toner image formed thereon.

The paper stacking unit 1 includes a paper cassette having a paper pressing plate supported by an elastic spring elastically urging (biasing) the printing paper P upward.

The paper conveying unit 2 includes a pick-up roller 9 feeding the printing paper P from the paper stacking unit 1 one by one, first and second paper conveying rollers 21 and 22 conveying the printing paper P fed by the pick-up roller 9, and a register roller 23 and a back-up roller 25 aligning the leading end of the printing paper P conveyed from the first and the second paper conveying rollers 21 and 22.

The paper sensing apparatus 30 sensing the leading end of the printing paper P is provided at a downstream side of the register roller 23 on a paper conveying path, which is disposed at a rear side of the register roller 23.

As shown in FIG. 2, the paper sensing apparatus 30 includes a sensor actuator 31 installed on a paper guide frame 24 to be elastically rotated by the printing paper P when the printing paper P is conveyed through the register roller 23 and a photo sensor 33 sensing an end portion of the sensor actuator 31 in accordance with a rotation of the sensor actuator 31 and sending a paper sensing signal to a controlling unit (not shown). The photo sensor 33 includes a light emitting unit emitting light and a light receiving unit receiving the light emitted from the light emitting unit.

The image forming unit 6 includes a photo sensitive drum 3, a developing roller 11 facing the photo sensitive drum 3, a toner supplying roller 13 supplying toner to the developing roller 11, a doctor blade 15 controlling an amount of the toner attached on the developing roller 11, an agitator 17 supplying the toner to the toner supplying roller 13, a toner container 19 storing the toner, and a case 18 provided for the above components to compose a single unit.

A transferring roller 5 is provided at a lower part of the photo sensitive drum 3 installed at the case 18. The settling unit 7 includes a heating roller 26 applying heat to the toner image transferred to the printing paper P from the photo sensitive drum 3 by the transferring roller 5, and a pressing roller 27 pressing the printing paper P against the heating roller 26.

The paper discharging unit 8 includes a paper discharging roller 28 discharging the printing paper P that has been completed with a printing operation, and a paper holder 29 holding and stacking the discharged printing paper P.

An operation of the laser printer 10 having the above structure is as follows. Firstly, the printing paper P is picked up from the paper stacking unit 1 by the pick-up roller 9 and conveyed to the register roller 23 through the first and the second conveying rollers 21 and 22.

The leading end of the printing paper P that has been conveyed to the register roller 23 is aligned by being pushed against a nip between the register roller 23 and the back-up roller 25.

Then, as the printing paper P continues to pass through the nip between the register roller 23 and the back-up roller 25, the leading end of the printing paper P pushes the sensor actuator 31 of the paper sensing apparatus 30 disposed between the register roller 23 and the transferring roller 5. Accordingly, the end portion of the sensor actuator 31 is rotated to be off from the photo sensor 33. As a result, the light receiving unit of the photo sensor 33 receives light from the light emitting unit and sends the paper sensing signal to the controlling unit (not shown).

The controlling unit counts time consumed for the printing paper P to be conveyed from the paper sensing apparatus 30 to the transferring roller 5 in accordance with the paper sensing signal, conveys the printing paper P for a predetermined time, i.e., until the printing paper P reaches a printing operation start position, and then operates the image forming unit 6 and the transferring roller 5.

While the printing paper P is being conveyed to the printing operation starting position, an electrostatic latent image is formed on the photo sensitive drum 3 of the image forming unit 6 by a laser beam reflected through a LSU (laser scanning unit) 4 in accordance with an image signal. The electrostatic latent image formed on the photo sensitive drum 3 is developed to a visible toner image by the developing roller 11.

Then, when the printing paper P reaches the photo sensitive drum 3 of the image forming unit 6, the toner image formed on the photo sensitive drum 3 is transferred to a surface of the printing paper P by the transferring roller 5 in accordance with a control of the controlling unit.

The toner image that has been transferred to the surface of the printing paper P is settled on the surface of the printing paper P by the heat and pressure of the heating roller 26 and the pressing roller 27 as being passed through the settling unit 7. The printing paper P having the toner image settled thereon is discharged to the paper holder 29 formed outside of the laser printer 10 by the paper discharging roller 28 of the paper discharging unit 8.

However, in the above conventional laser printer 10, as shown in FIGS. 3A and 3B, the leading end of the printing paper P is frequently bent due to a friction force or static electricity generated by a contact between the leading end of the printing paper P and the sensor actuator 31 of the paper sensing apparatus 30, and thus there is a problem that a contact point of the sensor actuator 31 and the leading end of the printing paper P is not constantly maintained.

As described above, when the contact point between the sensor actuator 31 and the printing paper P is not regularly maintained, an operation starting time of the paper sensing apparatus 30 becomes unstable. Therefore, the top margin of the printing image printed on the printing paper P also becomes irregular, and as a result, reliability of the laser printer 10 is lowered.

In addition, as shown in FIG. 2, since a distance between an original position and a moving position in which the sensor actuator 31 moves and returns to its original position during sensing the leading end of the printing paper P, is extended, in other words, since an operation range M of the sensor actuator 31 is widened, a distance between the register roller 23 and the transferring roller 5 should be maintained longer than the operation range M of the sensor actuator 31. Therefore, when the distance between the register roller 23 and the transferring roller 5 becomes longer, an error is generated in the laser printer 10 due to a lengthened conveying path of the printing paper P, and accordingly, there is a problem that an accuracy of the top margin of the image printed on the printing paper P is lowered.

SUMMARY OF THE INVENTION

The present invention has been made to overcome the above- and/or other problems of the related art. Accordingly, it is an aspect of the present invention to provide a paper sensing apparatus of an office machine, which has a sensor actuator installed to be operated with respect to a rotation center of a register roller in order to reduce a distance between the register roller and a transferring roller and an error generated when sensing a leading end of a sheet of printing paper for the purpose of accurate controlling of a position of a printing image on the sheet.

Additional aspects and advantages of the invention will be set forth in part in the description which follows and, in part, will be obvious from the description, or may be learned by practice of the invention.

The above and/or other aspects are accomplished by providing a paper sensing apparatus for controlling a printing position of an image printed by an image forming unit by sensing a leading end of a sheet of printing paper for use in the office machine. The paper sensing apparatus includes a paper stacking unit containing sheets of the printing paper, a pickup unit picking up the printing paper stacked on the paper stacking unit, a conveying unit having at least one conveying roller to convey the printing paper picked up by the pick-up unit and a back-up roller, and an image forming unit forming an image on the printing paper conveyed by the conveying unit. The paper sensing apparatus includes a sensor actuator disposed to pivot with respect to a pivot center of the conveying roller by the printing paper when the printing paper is conveyed, and a sensing unit generating a paper sensing signal in accordance with a rotation of the sensor actuator.

The sensor actuator includes a lever integrally formed with a paper top aligning unit, which is pivotably disposed at a shaft of the conveying roller, to align a leading end of the printing paper. Alternatively, the sensor actuator includes a lever pivotably disposed at the shaft of the conveying roller.

The sensing unit is a photo sensor including a light emitting unit and a light receiving unit.

It is possible that when the paper top aligning unit pivots by the printing paper, the sensor actuator is disposed above the printing paper, and the sensing unit is disposed below the printing paper.

In addition, the sensor actuator operates within a range of 0–5 mm, especially, 1–3 mm after the printing paper enters a nip between the conveying roller and the back-up roller.

The paper top aligning unit includes two supporting members pivotably secured to the shaft of the conveying roller and separated from each other at a predetermined interval, and a connection member connecting the two supporting members and having at least one contact aligning part, which aligns the leading end of the printing paper, integrally formed with the lever of the sensor actuator.

Alternatively, the paper top aligning unit includes, two supporting members pivotably secured to the shaft of the conveying roller and spaced-apart at a predetermined interval from each other, two contact aligning parts integrally formed with two supporting members to align the leading end of the printing paper, and a connection member connecting the two supporting members and having the lever of the sensor actuator integrally formed therewith.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
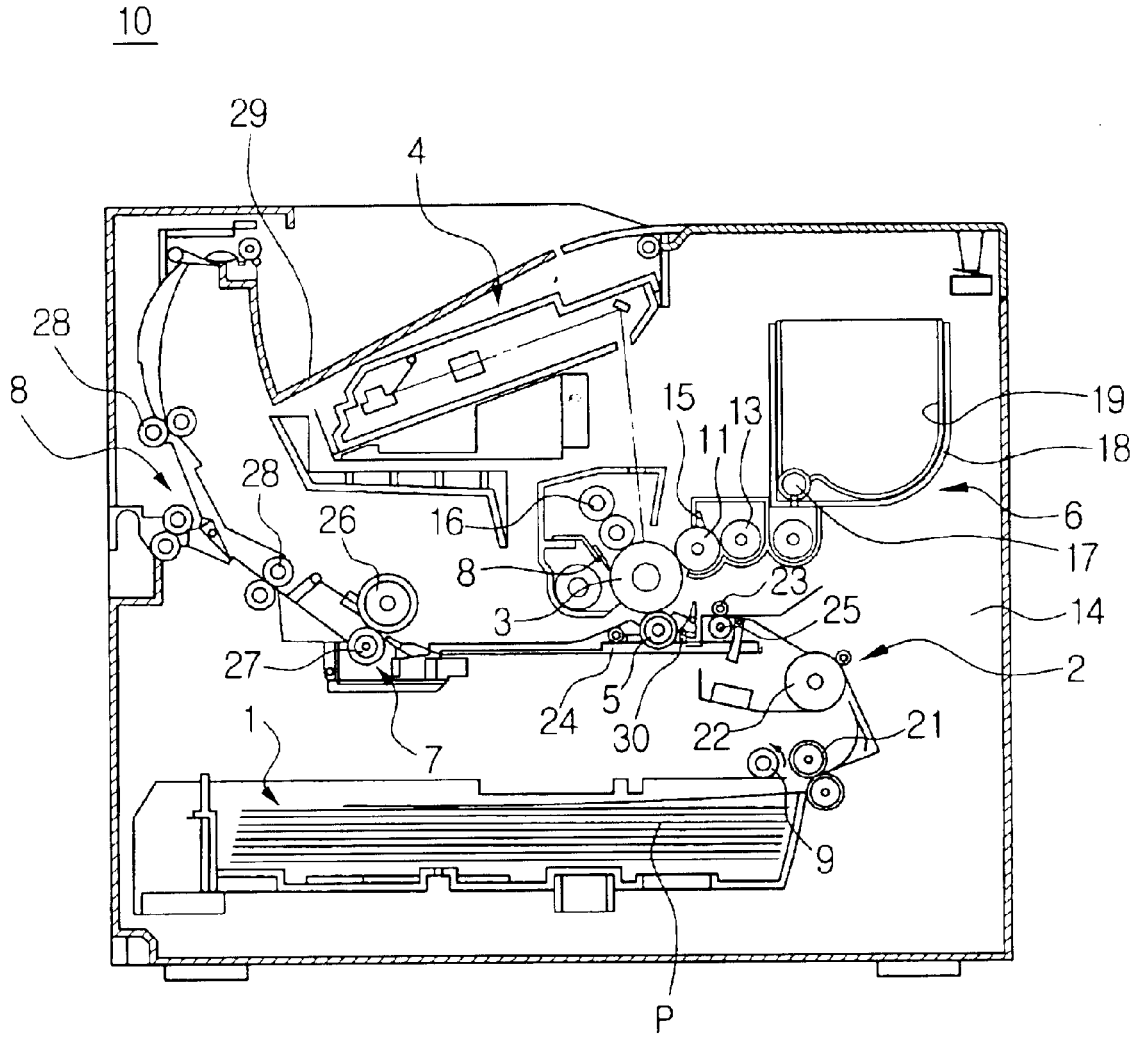
FIG. 1 (PRIOR ART)
FIG. 1 is a schematic view showing a conventional laser printer.
Figure 2:
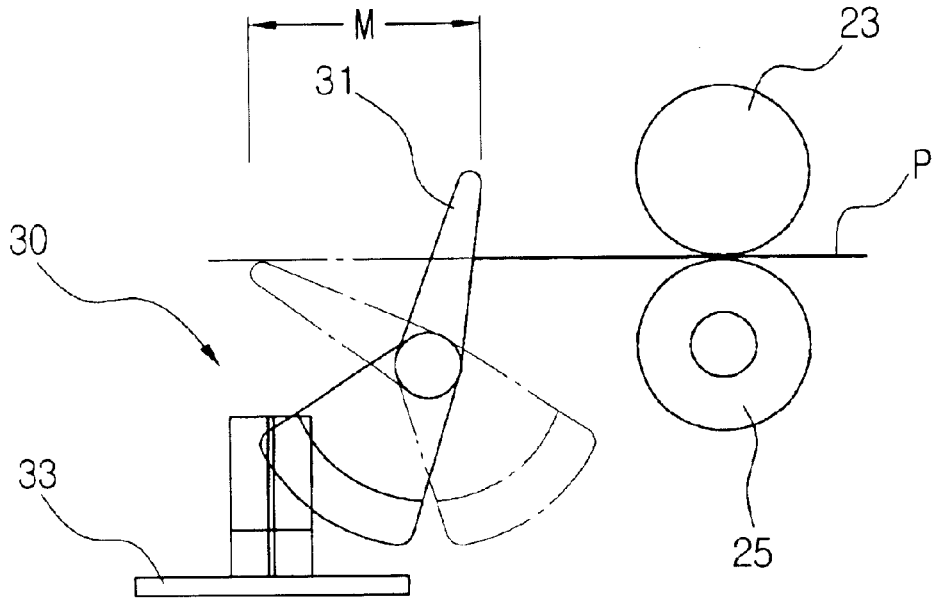
FIG.2 (PRIOR ART)
FIG. 2 is a side elevation view showing a paper sensing apparatus of the laser printer shown in FIG. 1.
Figure 3A:
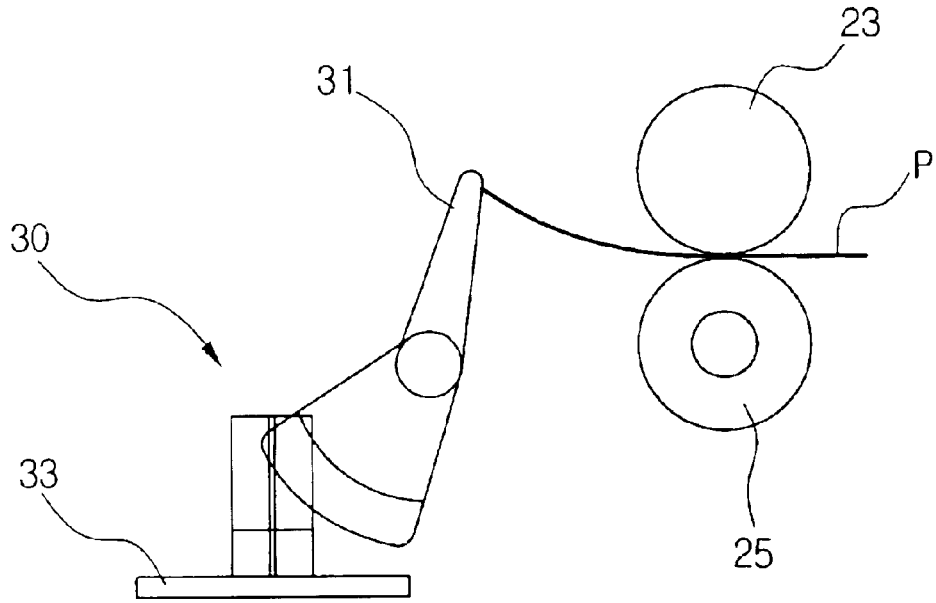
FIG.3A (PRIOR ART)
FIGS. 3A and 3B are side elevation views showing an operation of the paper sensing apparatus of FIG. 2.
Figure 3B:
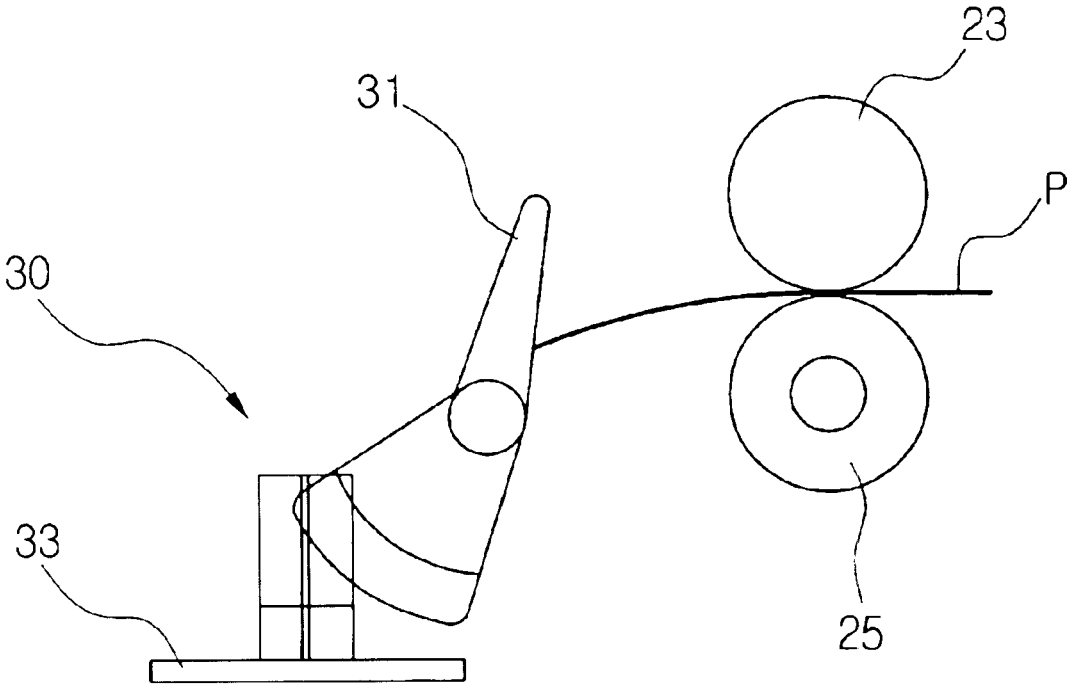
FIG.3B (PRIOR ART)

Reference will now be made in detail to the present preferred embodiments of the present invention, examples of which are illustrated in the accompanying drawings, wherein like reference numerals refer to the like elements throughout. The embodiments are described in order to explain the present invention by referring to the figures.

Hereinbelow, a paper sensing apparatus of an office machine according to embodiments of the present invention will be described in greater detail by referring to the appended drawings. For the drawings and the description of the embodiments, same parts with a conventional paper sensing apparatus will be marked as the same reference numerals and used for the description on the present invention.

Figure 5A:
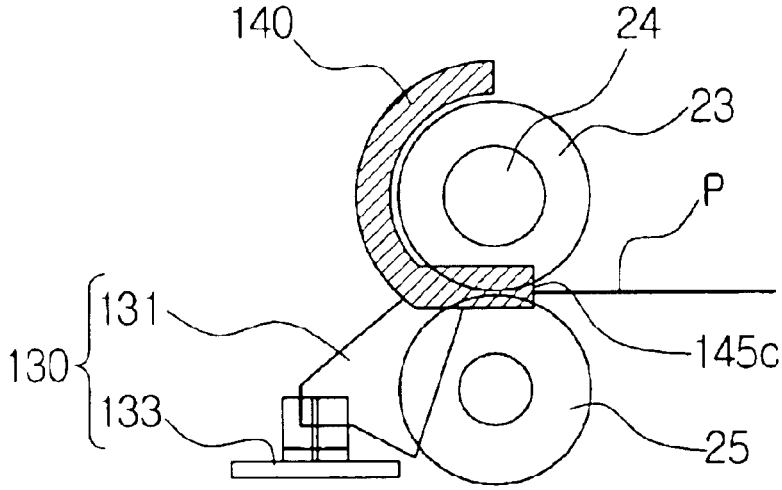
FIGS. 5A through 5C are sectional side elevation views showing an operation of the paper sensing apparatus shown in FIG. 4.

FIG. 5A is a view schematically showing a paper sensing apparatus 130 of the present invention, which is applied to an office machine such as a laser printer 10 shown in FIG.

The paper sensing apparatus 130 includes a sensor actuator 131 integrally formed with a paper top aligning unit 140, which is pivotably installed at a shaft 24 of a register roller 23 of the laser printer 10 shown in FIG. 1, aligning a leading end of a printing paper P, and a photo sensor 133 generating a sensing signal by sensing a leading end portion of the sensor actuator 131.

Figure 4:
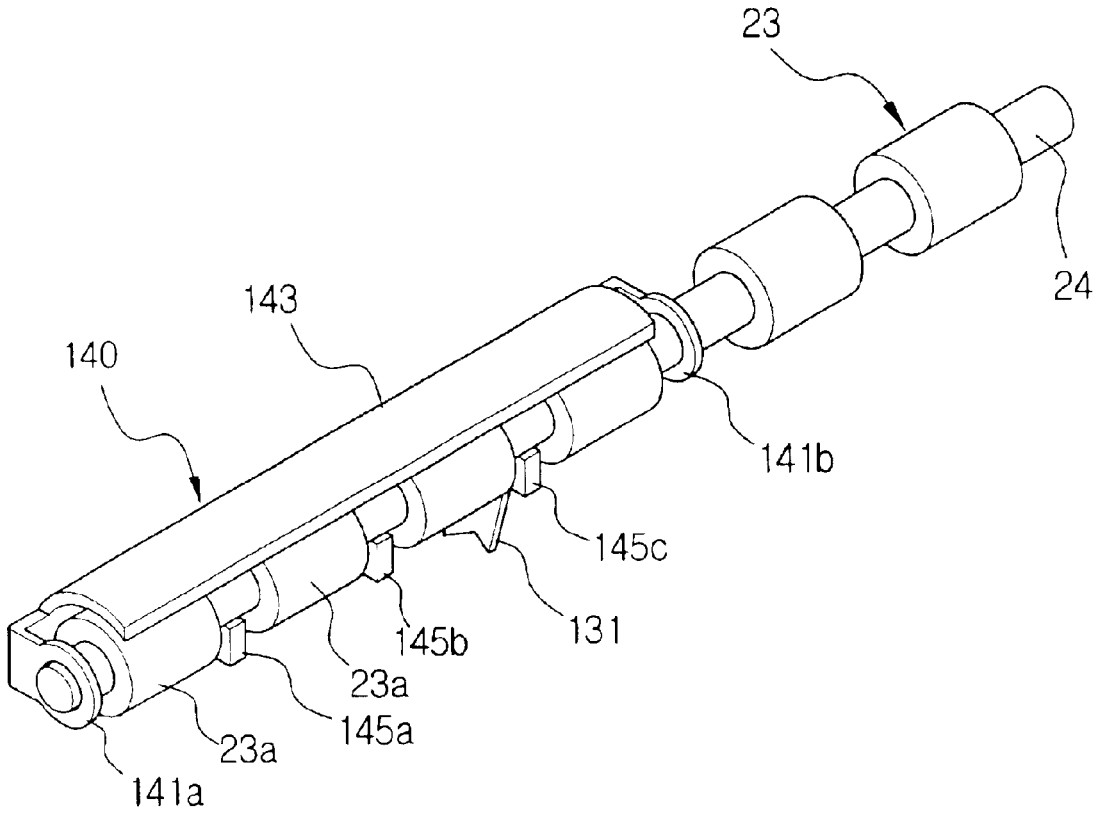
FIG. 4 is a perspective view showing a sensor actuator and a paper top aligning unit of a paper sensing apparatus according to an embodiment of the present invention.

As shown in FIG. 4, the paper top aligning unit 140 includes two supporting members 141*a* and 141*b* pivotably fixed at corresponding ends of the shaft 24 of the register roller 23, and a C-shape connection member 143 having first, second and third contact aligning parts 145*a*, 145*b* and 145*c* disposed between minor rollers 23*a* of the register roller 23. The C-shape connection member 143 connects the supporting members 141*a* and 141*b*.

As shown in FIG. 5A, in an original position of the paper top aligning unit 140, a center of gravity of the paper top aligning unit 140 is located such that the first, second and third contact aligning parts 145*a*, 145*b* and 145*c* are positioned before a nip between minor rollers (not shown) of a back-up roller 25 and the minor rollers 23*a* of the register roller 23. That is, front portions of the first through third contact aligning parts 145*a*, 145*b*, and 145*c* are disposed on an entrance of the nip. Therefore, when the printing paper P is conveyed to the register roller 23, the leading end of the printing paper P is aligned for the first time by the first, second and third contact aligning parts 145*a*, 145*b* and 145*c*, and after that, the leading end of the printing paper P is aligned for the second time by the nip between the minor rollers 23*a* of the register roller 23 and the minor rollers of the back-up roller 25.

The sensor actuator 131 having a lever is integrally formed with the third contact aligning part 145*c* at a lower part thereof in order to integrally pivot with the paper top aligning unit 140, and the sensor actuator 131 includes the leading end portion extended toward the photo sensor 133. The photo sensor 133 is provided at a paper guide frame (reference numeral 24 of FIG. 1) disposed at a paper conveying path of the printer so that the photo sensor 133 can be operated by the leading end portion of the lever of the sensor actuator 131. Accordingly, when the paper top aligning unit 140 pivots by the printing paper P, the sensor actuator 131 is disposed above the printing paper P while the photo sensor 133 is disposed below the printing paper P.

The photo sensor 133 includes a light emitting unit emitting light and a light receiving unit receiving the light emitted from the light emitting unit. The photo sensor 133 outputs a high signal, in other words, a high voltage in an 'on' state where the light emitted from the light emitting unit is received by the light receiving unit, and outputs a low signal, e.g., a low voltage, in an 'off' state where the light emitted from the light emitting unit is blocked by the leading end portion of the lever of the sensor actuator 131.

It is possible that the light emitting unit and the light receiving unit are constituted of a light emitting diode and a phototransistor, respectively.

Moreover, the paper sensing apparatus 130 includes a controlling unit controlling an operation of the image forming unit 6 and the transferring roller 5 based on the high or low signal of the photo sensor 133.

Therefore, the paper sensing apparatus 130 outputs the high signal to the controlling unit when the leading end of the printing paper P passes through the nip between the register roller 23 and the back-up roller 25 while being in contact with the paper top aligning unit 140 so that the controlling unit can control the operation of the transferring roller 5 and the image forming unit 6.

Figure 5B:
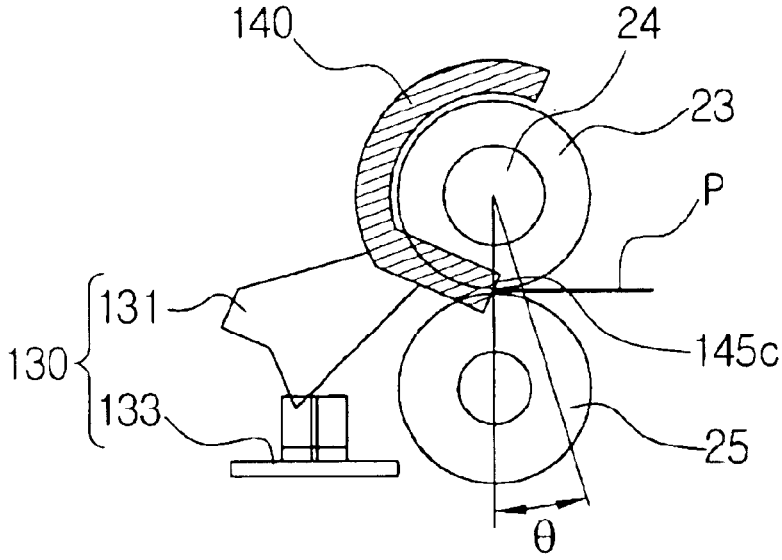

In other words, as shown in FIGS. 5A and 5B, when the printing paper P enters the nip between the register roller 23 and the back-up roller 25 with the leading end thereof coming into contact with the first, second and third contact aligning parts 145*a*, 145*b* and 145*c*, the paper top aligning unit 140 pivots with respect to an axis of the shaft 24 of the register roller 23 as much as an angle θ.

At this time, the sensor actuator 131 changes from the 'off' state where the phototransistor and the light emitting diode of the photo sensor 133 are blocked, to the 'on' state where the phototransistor and the light emitting diode communicate with each other.

Figure 5C:
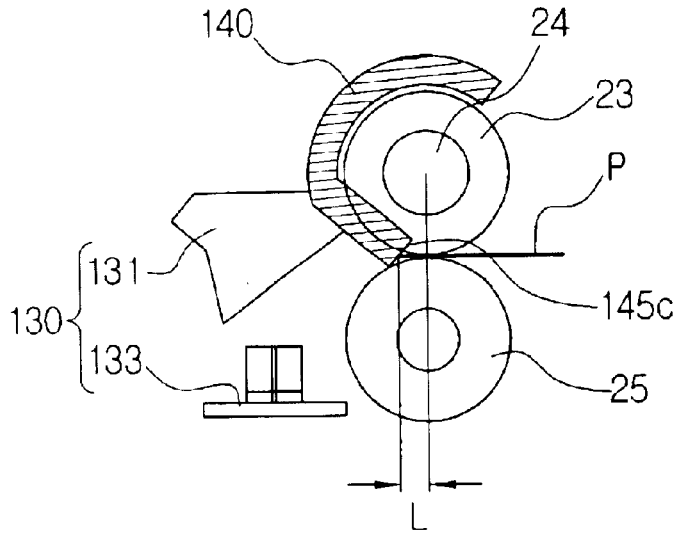

After that, as shown in FIG. 5C, when the printing paper P advances further as much as a distance L into the nip between the register roller 23 and the back-up roller 25, in other words, when the leading end of the printing paper P moves further in a range within 0–5 mm, especially 1–3 mm in the nip, the sensor actuator 131 is moved away from the photo sensor 133 and as a result, the phototransistor receives the light emitted from the light emitting diode, and thus the photo sensor 133 is turned on, and the high signal is generated.

Figure 6:
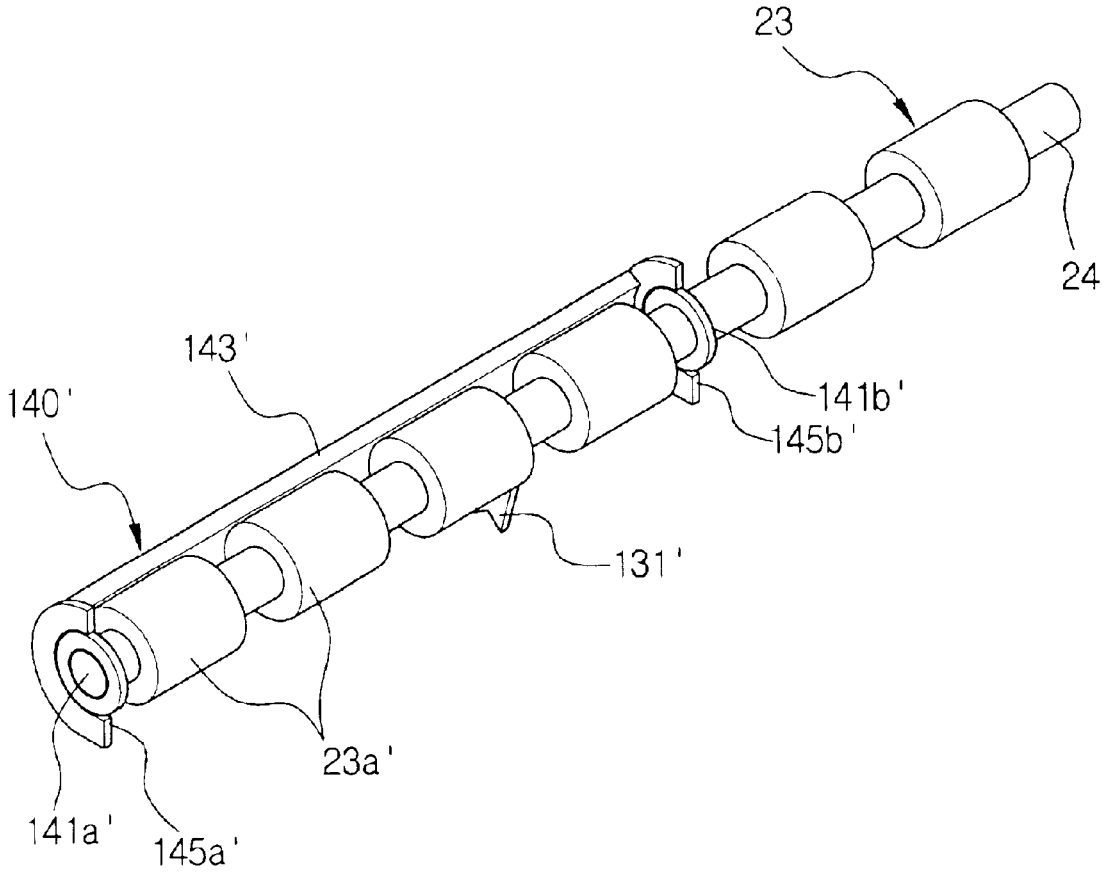
FIG. 6 is a perspective view showing another paper top aligning unit of a paper sensing apparatus according to another embodiment of the present invention.

FIG. 6 shows a paper top aligning unit 140' having the sensor actuator 131 of the paper sensing apparatus 130 according to another embodiment of the present invention.

The paper top aligning unit 140' includes supporting members 141*a*' and 141*b*' pivotably secured to the corresponding ends of the shaft 24 of the register roller 23 formed at a predetermined interval, contact aligning parts 145*a*' and 145*b*' integrally formed with the supporting members 141*a*' and 141*b*', and a bar-shape connection member 143' having an integrally formed lever of a sensor actuator 131' of the paper sensing apparatus 130. The bar-shape connection member 143' connects the supporting members 141*a*' and 141*b*'.

So far, the paper sensing apparatus 130 has been introduced and described based on the example in which the sensor actuators 131 and 131' are the levers integrally formed with the paper top aligning units 140 and 140'. However, the present invention is not limited to the embodiments dealt with here. For example, the levers of the sensor actuators 131 and 131' can be pivotably disposed at the shaft 24 of the register roller 23 while being separated from the paper top aligning units 140 and 140'.

Hereinbelow, the operation of the paper sensing apparatus 130 will be dealt with by referring to FIGS. 1, 4 and 5C.

First of all, when a command for printing is input into the controlling unit, the printing paper P is picked up one by one by the pick-up roller 9 from a paper stacking unit 1, and conveyed to the register roller 23 through the first and the second conveying rollers 21 and 22.

As shown in FIG. 5A, when the leading end of the printing paper P that has been conveyed to the register roller 23 contacts the first, second, and third contact aligning parts 145*a*, 145*b* and 145*c* of the paper top aligning unit 140 pivotably installed at the shaft 24 of the register roller 23, the printing paper P is aligned by a contact with the first, second, and third contact aligning parts 145*a*, 145*b* and 145*c*.

Then, as shown in FIG. 5B, when the leading end of the printing paper P enters the nip between the register roller 23 and the back-up roller 25, the paper top aligning unit 140 pivots with respect to the axis of the shaft 24 of the register roller 23 as much as the angle θ. At this time, the end portion of the sensor actuator 131 moves to change the photo sensor 133 from the 'off' state blocking the phototransistor and the light emitting diode of the photo sensor 133 to the 'on' state opening a communication between the phototransistor and the light emitting diode.

As shown in FIG. 5C, when the printing paper P advances further by 0–5 mm into the nip between the register roller 23 and the back-up roller 25, the end portion of the sensor actuator 131 is moved away from the photo sensor 133 and accordingly, the phototransistor receives the light emitted from the light emitting diode of the photo sensor 133. As a result, the photo sensor 133 is turned on, and the high signal is generated from the photo sensor 133 and sent to the controlling unit.

The controlling unit counts time required for the printing paper P to be conveyed from the register roller 23 to the transferring roller 5 in accordance with the high signal of the photo sensor 133, conveys the printing paper P for a predetermined time, i.e., until the printing paper P reaches a printing starting position, and operates the image forming unit 6 and the transferring roller 5.

As described so far, the paper sensing apparatus according to the present invention is capable of accurately sensing the leading end of the printing paper and thus the top margin of the printing paper can be effectively controlled as the paper sensing apparatus is installed to be operated with respect to the rotation center of the register roller so that the error generated when sensing paper top position and distance between the register roller and the transferring roller can be reduced.

Although the preferred embodiments of the present invention have been described, it will be understood by those skilled in the art that the present invention should not be limited to the described preferred embodiments, but various exchanges and modifications can be made within the spirit and the scope of the present invention. Accordingly, the scope of the present invention is not limited within the described range but the following claims and their equivalents.

What is claimed is:

1. A paper sensing apparatus for controlling a printing position of an image to be printed by sensing a leading end of a printing paper, for use in an office machine including a paper stacking unit containing sheets of printing paper, a pick-up unit picking up the printing paper stacked on the paper stacking unit, a conveying unit having at least one conveying roller to convey the paper picked up at the pick-up unit and one back-up roller, and an image forming unit to form an image on the printing paper conveyed by the conveying unit, comprising:

a sensor actuator disposed to pivot with respect to a pivot center of the conveying roller by the printing paper when the printing paper is conveyed to the conveying unit; and a sensing unit generating a paper sensing signal in accordance with a rotation of the sensor actuator, wherein the conveying roller comprises a shaft, and the sensor actuator comprises:

a paper top aligning unit, which is pivotably disposed at the shaft of the conveying roller, aligning a leading end of the printing paper; and a lever integrally formed with the paper top aligning unit to be associated with the sensing unit.

2. The paper sensing apparatus of claim 1, wherein the sensing unit comprises:

a photo sensor including a light emitting unit and a light receiving unit.

3. The paper sensing apparatus of claim 2, wherein, when the paper top aligning unit pivots by the printing paper, the sensor actuator is disposed above the printing paper conveyed by the conveying roller, and the sensing unit is disposed below the printing paper.

4. The paper sensing apparatus of claim 3, wherein the sensor actuator operates within a range of 0–5 mm when the printing paper enters a nip between the conveying roller and the back-up roller.

5. The paper sensing apparatus of claim 3, wherein the sensor actuator operates within a range of 1–3 mm when the printing paper enters a nip between the conveying roller and the back-up roller.

6. The paper sensing apparatus of claim 3, wherein the paper top aligning unit comprises:

two supporting members pivotably secured to corresponding ends of the shaft of the conveying roller and disposed at a predetermined interval from each other; and a connection member connecting two supporting members, and having at least one contact aligning part, which aligns the leading end of the printing paper, integrally formed with the lever of the sensor actuator.

7. The paper sensing apparatus of claim 3, wherein the paper top aligning unit comprises:

two supporting members pivotably secured to corresponding ends of the shaft of the conveying roller and disposed at a predetermined interval from each other;

two contact aligning parts integrally formed with corresponding ones of the two supporting members to align the leading end of the printing paper; and a connection member connecting the two supporting members, and having the lever of the sensor actuator integrally formed therewith.

8. A paper sensing apparatus for controlling a printing position of an image to be printed by sensing a leading end of a printing paper, for use in an office machine including a paper stacking unit containing sheets of printing paper, a pick-up unit picking up the printing paper stacked on the paper stacking unit, a conveying unit having at least one conveying roller to convey the paper picked up at the pick-up unit and one back-up roller, and an image forming unit to form an image on the printing paper conveyed by the conveying unit, comprising:

a sensor actuator disposed to pivot with respect to a pivot center of the conveying roller by the printing paper when the printing paper is conveyed to the conveying unit; and a sensing unit generating a paper sensing signal in accordance with a rotation of the sensor actuator, wherein the conveying roller comprises a shaft, and the sensor actuator comprises:

a lever pivotably disposed at the shaft of the conveying roller.

9. A paper sensing apparatus for controlling a printing position of an image to be printed on a printing paper by sensing a leading end of the printing paper passing along a path in an image forming apparatus, comprising:

a roller unit disposed on the path, and rotating to feed the printing paper;

a sensor actuator movably mounted on the roller;

a sensing unit generating a paper sensing signal in accordance with a movement of the sensor actuator; and a paper top aligning unit movably mounted on the roller, wherein the sensor actuator and the paper top aligning unit are simultaneously moved by the printing paper.

10. The paper sensing apparatus of claim 9, wherein the sensor actuator and the paper top aligning unit move when the printing paper contacts one of the sensor actuator and the paper top aligning unit.

11. The paper sensing apparatus of claim 9, wherein the sensor actuator and the paper top aligning unit move with respect to the same axis as the roller unit.

12. The paper sensing apparatus of claim 9, wherein the paper top aligning unit comprises a portion formed in a circular direction of the roller unit, and the sensor actuator is formed in a radial direction.

13. The paper sensing apparatus of claim 12, wherein the sensor actuator is extended from the portion of the paper top aligning unit in the radial direction toward the sensing unit.

14. The paper sensing apparatus of claim 9, wherein the paper top aligning unit comprises another portion formed in a longitudinal direction parallel to an axis of the roller unit.

15. The paper sensing apparatus of claim 14, wherein the sensor actuator is extended from the another portion of the paper top aligning unit in the radial direction toward the sensing unit.

16. A paper sensing apparatus for controlling a printing position of an image to be printed on a printing paper by sensing a leading end of the printing paper passing along a path in an image forming apparatus, comprising:

a roller unit disposed on the path, and rotating to feed the printing paper;

a sensor actuator movably mounted on the roller;

a sensing unit generating a paper sensing signal in accordance with a movement of the sensor actuator; and a paper top aligning unit rotatably mounted on the roller.

17. The paper sensing apparatus of claim 16, wherein the paper top aligning unit is integrally formed with the sensor actuator.

18. The paper sensing apparatus of claim 16, wherein the paper top aligning unit is formed with the sensor actuator in a monolithic single body.

19. A method of controlling a printing position of an image to be printed on a printing paper by sensing a leading end of the printing paper passing along a path in an image forming apparatus, comprising:

causing a paper top aligning unit and a sensor actuator to be movably mounted on a roller unit feeding the printing paper along the path;

simultaneously moving the paper top aligning unit and the sensor actuator by the leading end of the printing paper; and detecting a movement of the sensor actuator to generate a paper sensing signal corresponding to the printing position.

20. The method of claim 19, wherein the causing of the paper top aligning unit and the sensor actuator to be movably mounted on the roller unit comprises:

forming the paper top aligning unit and the sensor actuator in an integral body.

21. The method of claim 19, wherein the simultaneously moving of the paper top aligning unit and the sensor actuator comprises:

causing the paper top aligning unit to contact the leading end of the printing paper to align the printing paper.

22. The method of claim 21, wherein the simultaneously moving of the paper top aligning unit and the sensor actuator comprises:

causing the sensor actuator to move with respect to a sensing unit disposed to detect a movement of the sensor actuator to generate the paper sensing signal.

23. The method of claim 22, wherein the simultaneously moving of the paper top aligning unit and the sensor actuator comprises:

causing the sensor actuator not to contact the printing paper.

24. The method of claim 19, wherein the simultaneously moving of the paper top aligning unit and the sensor actuator comprises:

simultaneously aligning the printing paper and detecting the paper sensing signal corresponding to the printing position by using the paper top aligning unit and the sensor actuator unit, respectively.

25. A paper sensing apparatus for controlling a printing position of an image to be printed on a printing paper by sensing a leading end of the printing paper passing along a path in an image forming apparatus, comprising:

a roller unit disposed on the path, and rotating to feed the printing paper;

a sensor actuator movably mounted on the roller;

a sensing unit generating a paper sensing signal in accordance with a movement of the sensor actuator, wherein the roller unit comprises a shaft, and the sensor actuator is rotated about the shaft of the roller unit by the printing paper, and the roller unit comprises a plurality of minor rollers spaced-apart from each other along the shaft, and the sensor actuator is disposed between the minor rollers of the roller unit; and a paper top aligning unit disposed between the minor rollers of the roller unit.

26. The paper sensing apparatus of claim 25, wherein the paper top aligning unit comprises:

a plurality of aligning parts each disposed between the minor rollers of the roller unit.

27. The paper sensing apparatus of claim 26, wherein the sensor actuator is disposed between the aligning parts.

28. A paper sensing apparatus for controlling a printing position of an image to be printed on a printing paper by sensing a leading end of the printing paper passing along a path in an image forming apparatus, comprising:

a roller unit disposed on the path, and rotating to feed the printing paper;

a sensor actuator movably mounted on the roller;

a sensing unit generating a paper sensing signal in accordance with a movement of the sensor actuator, wherein the roller unit comprises a shaft, and the sensor actuator is rotated about the shaft of the roller unit by the printing paper; and a paper top aligning unit rotatably mounted around the shaft of the roller unit.

29. The paper sensing apparatus of claim 28, wherein the paper top aligning unit comprises a contact aligning part disposed to contact the leading end of the printing paper, and the sensor actuator is formed on a portion of the paper top aligning unit other than the contact aligning part.

30. The paper sensing apparatus of claim 29, wherein the roller unit comprises a register roller and a back-up roller forming a nip with the register roller, and the contact aligning part of the paper top aligning unit protrudes through the nip to contact the leading end of the printing paper before the leading end of the printing paper enters the nip.

31. The paper sensing apparatus of claim 28, wherein the paper top alignment unit comprises:

a supporting member rotatably mounted on the shaft; and a contact aligning part formed on the supporting member toward the path to contact the leading end of the printing paper.

32. The paper sensing apparatus of claim 28, wherein the paper top alignment unit comprises:

a plurality of supporting members rotatably mounted on corresponding portions of the shaft; and a plurality of contact aligning parts formed on corresponding ones of the supporting members to contact the leading end of the printing paper.

33. The paper sensing apparatus of claim 32, wherein the paper top alignment unit comprises:

a connection member disposed along a longitudinal direction of the roller unit and coupled between the supporting members.

34. The paper sensing apparatus of claim 33, wherein the sensor actuator is extended from the connection member.

35. The paper sensing apparatus of claim 32, wherein the sensor actuator is disposed between the supporting members.

36. A paper sensing apparatus for controlling a printing position of an image to be printed on a printing paper by sensing a leading end of the printing paper passing along a path in an image forming apparatus, comprising:

a roller unit disposed on the path, and rotating to feed the printing paper;

a sensor actuator movably mounted on the roller; and a sensing unit generating a paper sensing signal in accordance with a movement of the sensor actuator, wherein the roller unit comprises a shaft, and the sensor actuator comprises:

a supporting member rotatably mounted on the shaft, and a leading end portion extended from the supporting member toward the sensing unit.

37. The paper sensing apparatus of claim 36, wherein the leading end portion of the sensor actuator is disposed between both ends of the shaft of the roller unit.

38. A paper sensing apparatus for controlling a printing position of an image to be printed on a printing paper by sensing a leading end of the printing paper passing along a path in an image forming apparatus, comprising:

a roller unit disposed on the path, and rotating to feed the printing paper;

a paper top aligning unit rotatably mounted on the roller unit to contact the leading end of the printing paper;

a sensor actuator formed on the paper top aligning unit; and a sensing unit disposed to detect a movement of the sensor actuator.

39. The paper sensing apparatus of claim 38, wherein paper top aligning unit comprises a contact aligning part contacting the leading end of the printing paper, and the sensor actuator does not contact the leading end of the printing paper.

40. The paper sensing apparatus of claim 39, wherein the sensor actuator simultaneously moves together with the paper top aligning part of the paper top aligning unit.

41. The paper sensing apparatus of claim 38, wherein the paper top aligning unit and the sensor actuator rotate with respect to the roller unit.

* * * * *